US010961780B2

(12) United States Patent
Chen et al.

(10) Patent No.: US 10,961,780 B2
(45) Date of Patent: Mar. 30, 2021

(54) SYSTEMS AND METHODS FOR RAISING DRILLING RIG ASSEMBLIES

(71) Applicant: National Oilwell Varco, L.P., Houston, TX (US)

(72) Inventors: Fuquan Chen, Houston, TX (US); Robert Benjamin Donnally, Shanghai (CN); Hua Jiang, Shanghai (CN)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 26 days.

(21) Appl. No.: 16/093,478

(22) PCT Filed: May 9, 2016

(86) PCT No.: PCT/US2016/031413
§ 371 (c)(1),
(2) Date: Oct. 12, 2018

(87) PCT Pub. No.: WO2017/196291
PCT Pub. Date: Nov. 16, 2017

(65) Prior Publication Data

US 2020/0048965 A1 Feb. 13, 2020

(51) Int. Cl.
*E21B 7/02* (2006.01)
*E21B 15/00* (2006.01)
(Continued)

(52) U.S. Cl.
CPC ..... *E21B 7/02* (2013.01); *E21B 15/003* (2013.01); *B66F 11/042* (2013.01); *E02D 7/16* (2013.01); *E04H 12/345* (2013.01); *E21B 15/04* (2013.01)

(58) Field of Classification Search
CPC ..... E21B 7/02; E21B 15/003; E21B 15/04; E04H 12/345; E02D 7/16; B66F 11/042
(Continued)

(56) References Cited

U.S. PATENT DOCUMENTS 4,267,675 A * 5/1981 Cochran ..... E21B 7/023 212/348
4,821,816 A * 4/1989 Willis ..... E21B 15/00 175/57

(Continued)

FOREIGN PATENT DOCUMENTS

DE 4436264 C1 * 11/1995 ..... E21B 7/023
DE 4436264 C1 11/1995

OTHER PUBLICATIONS

International Search Report and Written Opinion from PCT/US2016/031413 dated Dec. 8, 2016.

*Primary Examiner* — Brian E Glessner
*Assistant Examiner* — Adam G Barlow
(74) *Attorney, Agent, or Firm* — Schwegman Lundberg & Woessner, P.A.

(57) ABSTRACT

A mast erection system includes a first mast erection apparatus that is adapted to pivotably raise a drilling rig mast of a drilling rig assembly to an intermediate raised position wherein the drilling rig mast is oriented at a first acute angle relative to a horizontal plane, and a second mast erection apparatus that is adapted to further pivotably raise the drilling rig mast from the intermediate raised position at the first acute angle to a fully raised position wherein the drilling rig mast is oriented at a second angle relative to the horizontal plane that is greater than the first acute angle.

15 Claims, 12 Drawing Sheets

(51) Int. Cl.

| | |
|---|---|
| *B66F 11/04* | (2006.01) |
| *E02D 7/16* | (2006.01) |
| *E04H 12/34* | (2006.01) |
| *E21B 15/04* | (2006.01) |

(58) Field of Classification Search
USPC ..... 52/118–120, 143, 651.05, 745.17
See application file for complete search history.

(56) References Cited

U.S. PATENT DOCUMENTS

| | | | | |
|---|---|---|---|---|
| 8,468,753 | B2 | 6/2013 | Donnally et al. | |
| 8,549,815 | B2 * | 10/2013 | Donnally | E21B 7/02 52/745.17 |
| 9,016,004 | B2 * | 4/2015 | Vogt | E04H 12/18 52/118 |
| 10,329,788 | B2 * | 6/2019 | Jonah | E04H 12/345 |
| 2005/0193645 | A1 | 9/2005 | Barnes | |
| 2009/0200856 | A1 | 8/2009 | Chehade et al. | |
| 2009/0218139 | A1 | 9/2009 | Donnally et al. | |
| 2009/0320385 | A1 | 12/2009 | Stoetzer et al. | |
| 2013/0140091 | A1 | 6/2013 | Lanzl et al. | |
| 2015/0240562 | A1 * | 8/2015 | Ferrari | E21B 7/023 52/118 |
| 2016/0040491 | A1 * | 2/2016 | Law | E21B 7/02 175/24 |
| 2016/0298394 | A1 * | 10/2016 | Padira | E04H 12/345 |
| 2018/0016855 | A1 * | 1/2018 | Lee | E21B 7/024 |
| 2020/0048965 | A1 * | 2/2020 | Chen | E21B 15/003 |

* cited by examiner

SYSTEMS AND METHODS FOR RAISING DRILLING RIG ASSEMBLIES

BACKGROUND

1. Field of the Disclosure

The present subject matter is generally directed to drilling rigs used for oil and gas well drilling, and in particular, to systems and methods that may be used for raising/erecting the various components of drilling rig assemblies, including drilling rig masts and sub structures.

2. Description of the Related Art

In many land-based oil and gas drilling operations, drilling rigs are delivered to an oilfield drilling site by transporting the various components of the drilling rig over roads and/or highways. Typically, the various drilling rig components are transported to a drilling site on one or more truck/trailer combinations, the number of which may depend on the size, weight, and complexity of the rig. Once at the drilling site, the drilling rig components are then assembled, and the drilling rig assembly is raised to an operating position so as to perform drilling operations. After the completion of drilling operations, the drilling rig is then lowered, disassembled, loaded back onto truck/trailer combinations, and transported to a different oilfield drilling site for new drilling operations. Accordingly, the ease with which the various drilling rig components can be transported, assembled and disassembled, and raised and lowered can be a substantial factor in the drilling rig design, as well as the rig's overall operational capabilities and cost effectiveness.

As drilling rig technologies have progressed, the size and weight of drilling rigs has significantly increased so as to meet the higher drilling load capabilities that are oftentimes required to drill deeper wells, particularly in more mature oilfield formations. For example, it is not uncommon for many land-based drilling rigs to have a 1500-2000 HP capability, with hook load capacities of 450 metric tons (1000 kips) or greater. Additionally, there are some even larger drilling rigs in operation, such as 3000 HP rigs with hook and/or rotary load capacities exceeding 680 metric tons (1500 kips). Moreover, as drilling depths have increased, operators have also generally increased the setback capacity requirements for most land-based rigs, such as in the range of approximately 225-275 metric tons (500-600 kips) or more, so as to be able to handle the increased loads associated with larger and longer drill strings.

However, as the capacity and the overall size and weight of land-based drilling rigs increases, the size and weight of many of the various components of the rig also proportionately increase, a situation that can sometimes contribute to an overall reduction in at least some of the transportation characteristics of the rig. For example, a typical drawworks for a 2000 HP mobile rig may weigh in the range of 35-45 metric tons (80-100 kips), or even more. Furthermore, individual sections of a drilling rig mast may be 9-12 meters (30-40 feet) or more in length, and may weigh 10-35 metric tons (20-80 kips). In many past applications, such large and heavy components often required the use of a suitably sized crane so as to lift and position the various rig components during rig assembly and erection. Accordingly, while each the various larger rig components might have been "transportable" over roads and/or highways from one oilfield drilling site to another, the overall logistical considerations for using at least some of these higher capacity mobile drilling rigs, e.g., 1500 HP and greater, often required the need to include having a crane present at a given drilling site prior to the commencement of drilling operations in order to facilitate initial rig assembly. Furthermore, a crane would have also been present after the completion of drilling operations so as to support the rig disassembly activities prior to the transportation of the rig to a rig storage yard or to other oilfield drilling sites. As may be appreciated, the requirement for using a crane during such assembly, erection, and/or disassembly stages had a significant impact on the overall cost of a given drilling operation, as well as on the amount of time that was needed to perform the operations. As such, many modern drilling rigs are designed and constructed in an effort to avoid the use of cranes for rig assembly, erection, and disassembly support. FIGS. 1A-1C and FIGS. 2A-2C illustrate two different approaches that have been used is some prior art applications to raise/erect drilling rig masts and drilling rig assemblies without the use of cranes.

FIGS. 1A-1C are side elevation views of a drilling rig assembly 100 that uses a first hydraulic cylinder 114 to raise a drilling rig mast 130, and uses a second different hydraulic cylinder to raise the substructure 110 of the rig assembly 100. As will be appreciated by those of ordinary skill, while the various elevation views shown in FIGS. 1A-1C depict a single hydraulic cylinder 114 and a single hydraulic cylinder 116, these cylinders are typically provided in pairs and positioned such that they straddle the components being raised or erected, and as such any reference herein to a "hydraulic cylinder 114" or a "hydraulic cylinder 116" should generally be understood to encompass pairs of hydraulic cylinders 114 and/or 116 unless specifically noted otherwise.

With reference to FIG. 1A, the drilling rig assembly includes a substructure 110 that has an upper substructure box 111 and a lower substructure box 112. The substructure 110 is depicted in FIG. 1A in a collapsed configuration, that is, before the substructure 110 has been raised to an operating configuration as will be discussed further below. The lower substructure box 112 is positioned in bearing contact with the ground, or a drilling mat positioned on the ground, as indicated in FIG. 1A by reference number 190. A drawworks 120 is positioned on a drawworks skid 122 that is coupled to the upper substructure box 111. The lower end of a mast raising cylinder 114 is pivotably connected to the lower substructure box 112 at a lower pivot point 114*p*, and the lower end of a substructure raising cylinder 116 is pivotably connected to the lower substructure box 112 at a lower pivot point 116*p*. Additionally, the upper end of the second raising cylinder 116 is pivotably connected to a substructure erection lug 113 that is attached to the upper substructure box 111. The substructure 110 also includes a mast support shoe 115 connected to the upper substructure box 111, as well as support legs 118 that are pivotably connected at respective ends to the upper and lower substructure boxes 111, 112.

FIG. 1B is a side elevation view of the drilling rig assembly 100 after the completion of a mast raising/erection step. In particular, a support leg 133 of the drilling rig mast 130 has been pivotably connected to the mast support shoe 115 and pivotably raised to a fully erected operating position. Furthermore, the upper end of the mast raising cylinder 114 has been pivotably connected to a mast erection lug 131 on the drilling rig mast 130, and the mast raising cylinder 114 has been actuated (extended) so as to pivotably rotate the mast 130 into the fully erected position, as indicated.

Typically, the mast raising cylinder 114 is a multi-stage telescopic hydraulic cylinder, wherein the number of stages depends on the total extended length requirement for raising the mast 130 to the fully erected position (four stages shown in the depicted configuration). Depending on the specific drilling rig design and rig component transportation requirements, the drilling rig mast 130 can be made up of a single mast section, or it can be assembled by removably coupling together two or more mast sections. For example, the drilling rig mast 130 can include a bottom mast section 132 and a top mast section 134 as illustrated in FIG. 1B, or it can also include any number of appropriately sized intermediate mast sections (not shown). Additionally, the drilling rig mast 130 can be erected after a fingerboard or diving board platform 135 used in handling the upper ends of drill pipe strings (not shown) has been attached to the mast 130, as is shown in FIG. 1B.

FIG. 1C is a side elevation view of the drilling rig assembly 100 after the completion of a further rig raising/erection step, wherein the substructure 110 with the drilling rig mast 130 and drawworks 120 positioned thereof has been raised to an operating height/configuration for performing drilling operations. As shown in FIG. 1C, the mast raising cylinder 114 has been detached from the mast erection lug 131, after which it is again actuated so as to be fully retracted to the configuration shown. Once the mast raising cylinder 114 has been detached from the mast lug 131, the substructure raising cylinder 116 is then actuated (extended) so as to raise the upper substructure box 111 above the lower substructure box 112 by pivotably rotating each of the substructure support legs 118. As shown in the illustrated example, the substructure raising cylinder 116 can also be a multi-stage telescopic hydraulic cylinder, wherein the size of the cylinder and the number of stages are adjusted for the particular rig requirement.

After the substructure 110 has been erected as shown, various substructure braces 119 are pinned in place to the upper and lower substructure boxes 111, 112 so as to maintain the substructure 110 in the raised operating position. As depicted in the illustrated configuration, a drawworks brace 123 can also be installed between the lower substructure box 112 and the drawworks skid 122 so as to provide additional support for the drawworks 120.

As is appreciated by the ordinarily skilled artisan, multi-stage telescopic hydraulic cylinders are typically highly engineered pieces of equipment, and consequently can be very expensive to purchase and maintain. For example, it is not unusual to require four-stage telescopic cylinders having a fully stroked, maximum extended length of 12-17 meters (40-55 feet) to raise a dressed out drilling rig mast weighing in the range of 70-115 metric tons (75-125 kips), or even more, to the erected operating position. Furthermore, with the higher setback capacities that are sometimes demanded by operators for modern drilling rigs, such as in the range of approximately 225-275 metric tons (500-600 kips) or more, the overall dead weight of rigs has generally increased, thus affecting the erection load requirements for raising the substructure 110 of a fully dressed out drilling rig assembly 100.

Additionally, it should be understood that pivot points 114*p*, 116*p* of the pinned lower ends of each of the raising cylinders 114, 116 can be located in positions on the lower substructure box 112 such that the size and length of the cylinders does not generally have an impact on the transportation of the substructure 110 to and from a drilling site. For example, the pivot points 114*p*, 116*p* where the cylinders 114, 116 are pinned to the lower substructure box 112 can be positioned such that the cylinders can be fully retracted and pivotably rotated to respective transportation orientations such that the raising cylinders 114, 116 do not unduly affect the overall shipping clearance of the substructure 110 during transportation. Accordingly, such positioning of the pivot points 114*p*, 116*p* generally allows the overall collapsed height 110*h* of the substructure 110 (see, FIG. 1A) to be substantially minimized, such as in the range of approximately 2.4-3.7 meters (8-12 feet). This minimized collapsed substructure height 110*h* thus enables the overall size of the shipping envelope to be within the limitations that are typically imposed on oversized transportation loads, thus allowing the substructure 110 to be transported over most roads and/or highways without using special routes or requiring special permitting particularly in North America, where shipping height limitations can often be restrictive. However, adjusting the positioning of the hydraulic raising cylinders 114, 116 in this fashion can result in an increase of the maximum extended length requirements for the cylinders 114, 116. Moreover, when coupled with the greater rig assembly loads that may be associated with erecting the drilling rig mast 130 and raising the substructure 110 of such higher capacity (heavier) drilling rig assemblies, such longer extended length requirements for the raising cylinders 114, 116 can sometimes have a substantial, detrimental impact on the cost of these equipment items.

FIGS. 2A-2C are side elevation views of a drilling rig assembly 200 wherein only one hydraulic cylinder 214 is used to raise both the drilling rig mast 230 and the substructure 210 of the rig assembly 200, thus avoiding some of the additional costs that are associated with using separate and dedicated hydraulic cylinders to raise the mast 130 and substructure 110 of the drilling rig assembly 100 shown in FIGS. 1A-1C. Again, as with the previously described prior art configuration of FIGS. 1A-1C, while the various elevation views depicted in FIGS. 2A-2C show a single hydraulic cylinder 214, a pair of cylinders 214 is typically provided and positioned such that they straddle the components being raised or erected, and as such any reference in the description below to a "hydraulic cylinder 214" should generally be understood to encompass a pair of hydraulic cylinders 214 unless noted otherwise.

FIG. 2A is a side elevation view of the drilling rig assembly 200 in an early stage of rig assembly, before either the drilling rig mast 230 or the substructure 210 have been raised to their respective operating positions. As shown in FIG. 2A, the substructure 210 is depicted in a collapsed configuration and positioned on the ground 290 (or drilling mat) at a drilling site, and includes an upper substructure box 211 that is coupled to a lower substructure box 212 by a plurality of support legs 218 and braces 219. Each of the support legs 218 and braces 219 is pivotably connected at a lower end thereof to the lower substructure box 212 at an upper end thereof to the upper substructure box 211. Additionally, a drawworks 220 has been positioned on the upper substructure box 211.

With continuing reference to FIG. 2A, the drilling rig mast 230 includes a bottom mast section 232, a top mast section 234, and a plurality of intermediate mast section 236 positioned between and connecting the top mast section 234 to the bottom mast section 232. Furthermore, a fingerboard or diving board platform 235 is attached to the drilling rig mast 230 at an appropriate location to facilitate the handling of tubular goods during well tripping operations. Also as shown in FIG. 2A, a mast support leg 233 at the lower end of the bottom mast section 232 is pivotably connected to a mast support shoe 215 positioned above the upper substructure box 211. Additionally, the lower end of the hydraulic raising cylinder 214 is depicted as being pivotably connected at a lower pivot point 214*p* on the lower substructure box 212, and the upper end of the cylinder 214 is pivotably connected to a mast raising lug 231 that is positioned on the bottom mast section 232.

FIG. 2B is a side elevation view of the drilling rig assembly 200 after the completion of a mast raising/erection step. In particular, the hydraulic raising cylinder has been actuated (extended) so as to pivotably raise the drilling rig mast 230 to a fully erected operating position by rotating the mast 230 about a pinned connection between the mast support leg 233 and the mast support shoe 215. Typically, as with the mast raising cylinder 114 of the previously described drilling rig assembly 100, the hydraulic raising cylinder 214 is a multi-stage telescopic hydraulic cylinder, wherein the number of stages depends on the total extended length requirement for raising the mast 230 to the fully erected position (four stages shown in the configuration illustrated in FIG. 2B).

FIG. 2C is a side elevation view of the drilling rig assembly 200 after the substructure 210 with the drilling rig mast 230 and drawworks 220 positioned thereon has been raised to an operating height/configuration for performing drilling operations. As shown in FIG. 2C, the upper end of the hydraulic raising cylinder 214 has been detached from the mast erection lug 231, after which the cylinder 214 is actuated (retracted) and pivoted about the lower pivot point 214*p* to a new orientation, and the upper end of the cylinder is pivotably connected to a substructure erection lug 213 on the upper substructure box 211. Thereafter, the hydraulic raising cylinder 214 is once again actuated (extended) so as to raise the upper substructure box 211 above the lower substructure box 212 by pivotably rotating each of the substructure support legs 218 and the braces 219. Once the upper substructure box 211 has been raised to proper operating height above the lower substructure box 212, the braces 219 are fixed in place so as to stabilize the substructure 210. Additionally, as shown in FIG. 2C, a drawworks support brace 223 can also be pinned in place between the upper and lower substructure boxes 211, 212.

While a significant cost savings can be realized by using the same hydraulic cylinder 214 to perform both the mast and substructure raising operations for the drilling rig assembly 200, such a system can have a detrimental impact on the "transportability" of the resulting substructure 210. In particular, since the lower end of the hydraulic raising cylinder 214 remains pinned to a single common pivot point 214*p* for both the mast raising operations and the substructure raising operation, the number of possible locations that the substructure erection lug 213 can be positioned on the upper substructure box 211 are limited. For example, due to the 12-plus meter (40-plus foot) maximum extended cylinder length that is sometimes necessary in order to raise the drilling rig mast 230 to its fully erected operating position, a very robust multi-stage telescopic hydraulic cylinder design is often required, such as a four-stage telescopic cylinder. Furthermore, when giving due consideration to overall lifting capacity and cylinder stability under all required loading conditions, such as dead loads, wind loads, and the like, the fully retracted length of the resulting multi-stage hydraulic cylinders can still be quite large, such as in the range of approximately 4.6-6.1 meters (15-20 feet) or more.

In view of the above-noted practical limitations on the design and sizing of a multi-stage telescopic hydraulic cylinder, the substructure 210 must have a minimum overall height 210*h* (in its collapsed configuration; see, FIG. 2A) that is sufficiently great enough to allow the upper end of the hydraulic raising cylinder 214 (in its fully retracted configuration) to be pinned, i.e., pivotably connected, to an erection lug 213 on the upper substructure box 211. Therefore, the collapsed height 210*h* of the substructure 210 cannot be too low, otherwise it may not be possible to pin the upper end of the hydraulic cylinder 214 to the upper substructure box 211 in a position that would allow the upper substructure box 211 to be raised above the lower substructure box 212 in the manner shown in FIG. 2C. In such cases, the resulting minimum collapsed height 210*h* of the substructure 210 may therefore need to be in the range of approximately 3.7-4.9 meters (12-16 feet) or more. Accordingly, the overall shipping height requirements for the substructure 210 (e.g., the minimum collapsed height 210*h* of the substructure 210 plus the additional height of the transporting truck or trailer) may exceed approximately 6.1-7 meters (20-23 feet) or more, which is generally too high to allow the substructure 210 to be transported over most roads and/or highways, particularly in North America, where shipping height limitations are generally at or below the range of approximately 4.9-5.8 meters (16-19 feet). Accordingly, the locations where rigs such as the drilling rig assembly 200 illustrated in FIGS. 2A-2C can be readily transported may be limited to applications in areas of the world where such shipping height limitations do not always exist, such as for desert applications in the Middle East or Central Asia.

Accordingly, there is a need to develop and implement new designs and methods for assembling and erecting modern drilling rigs having higher operating capacities while providing the type of shipping clearances that allow for the transportation of such rigs and components over highways and roads. The following disclosure is directed to systems and methods for raising drilling rig masts that address, or at least mitigate, at least some of the problems outlined above.

SUMMARY OF THE DISCLOSURE

The following presents a simplified summary of the disclosure in order to provide a basic understanding of some aspects of the subject matter that is described in further detail below. This summary is not an exhaustive overview of the disclosure, nor is it intended to identify key or critical elements of the subject matter disclosed here. Its sole purpose is to present some concepts in a simplified form as a prelude to the more detailed description that is discussed later.

Generally, the subject matter disclosed herein is directed to new and unique systems and methods that may be used for raising/erecting the various components of drilling rig assemblies, including drilling rig masts and substructures. In one illustrative embodiment disclosed herein, a mast erection system includes, among other things, a first mast erection apparatus that is adapted to pivotably raise a drilling rig mast of a drilling rig assembly to an intermediate raised position wherein the drilling rig mast is oriented at a first acute angle relative to a horizontal plane, and a second mast erection apparatus that is adapted to further pivotably raise the drilling rig mast from the intermediate raised position at the first acute angle to a fully raised position wherein the drilling rig mast is oriented at a second angle relative to the horizontal plane that is greater than the first acute angle.

In another illustrative embodiment of the present disclosure, a drilling rig assembly erection system includes a drilling rig substructure and a drilling rig mast that is adapted to be pivotably connected to the drilling rig substructure. The erection system also includes, among other things, an hydraulic cylinder that is adapted to raise the drilling rig mast by pivotably rotating the drilling rig mast from a substantially horizontal orientation to an intermediate raised position wherein the drilling rig mast is oriented at a first acute angle relative to a horizontal plane. Additionally, the system further includes a drilling rig drawworks that is adapted to further raise the drilling rig mast by pivotably rotating the drilling rig mast from the intermediate raised position to a fully raised operating position wherein the drilling rig mast is oriented at a second angle relative to the horizontal plane that is greater than the first acute angle.

Also disclosed herein is an exemplary method of erecting a drilling rig mast that is directed to, among other things, pivotably connecting a drilling rig mast to a collapsible drilling rig substructure, pivotably connecting a first erection raising apparatus to the drilling rig mast, and pivotably raising the drilling rig mast with the first mast erection apparatus to an intermediate raised position such that the drilling rig mast is oriented at a first acute angle relative to a horizontal plane. The disclosed method further includes, among other things, coupling a second mast erection apparatus to the drilling rig mast, and pivotably raising the drilling rig mast with the second mast erection apparatus from the intermediate raised position at the first acute angle to a fully raised operating position such that the drilling rig mast is oriented at a second angle relative to the horizontal plane that is greater than the first acute angle.

BRIEF DESCRIPTION OF THE DRAWINGS

The disclosure may be understood by reference to the following description taken in conjunction with the accompanying drawings, in which like reference numerals identify like elements, and in which:

FIGS. 3A-3F are side elevation views of an illustrative drilling rig assembly according to the present disclosure.

Figure 1A:
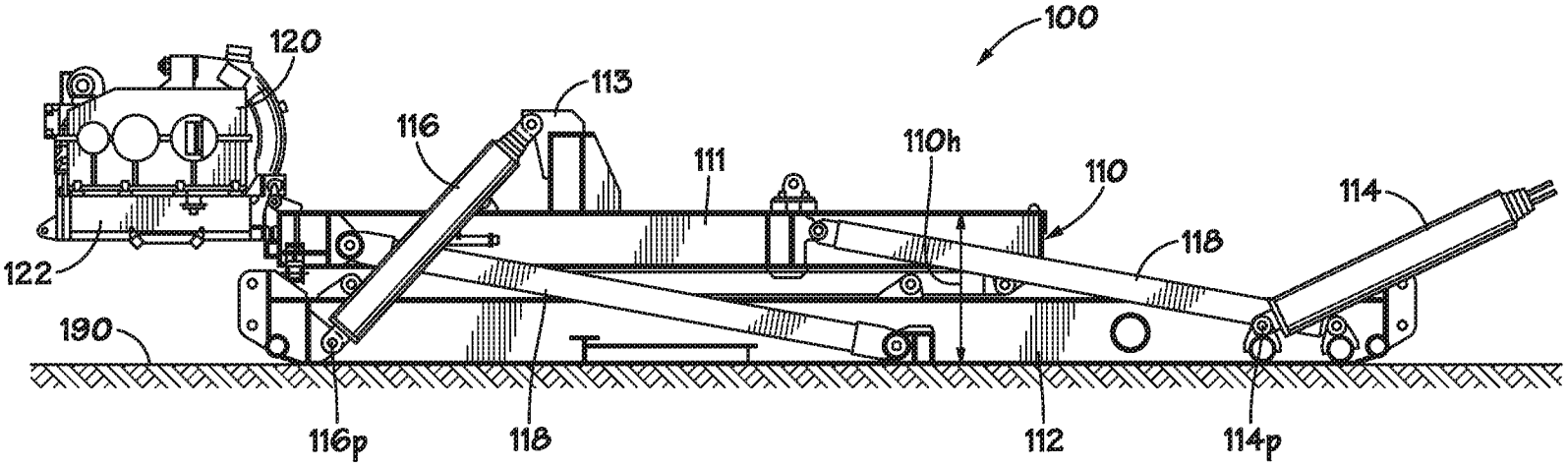
FIG. 1A (Prior Art)
FIGS. 1A-1C are side elevation views of an exemplary prior art drilling rig assembly.
Figure 1B:
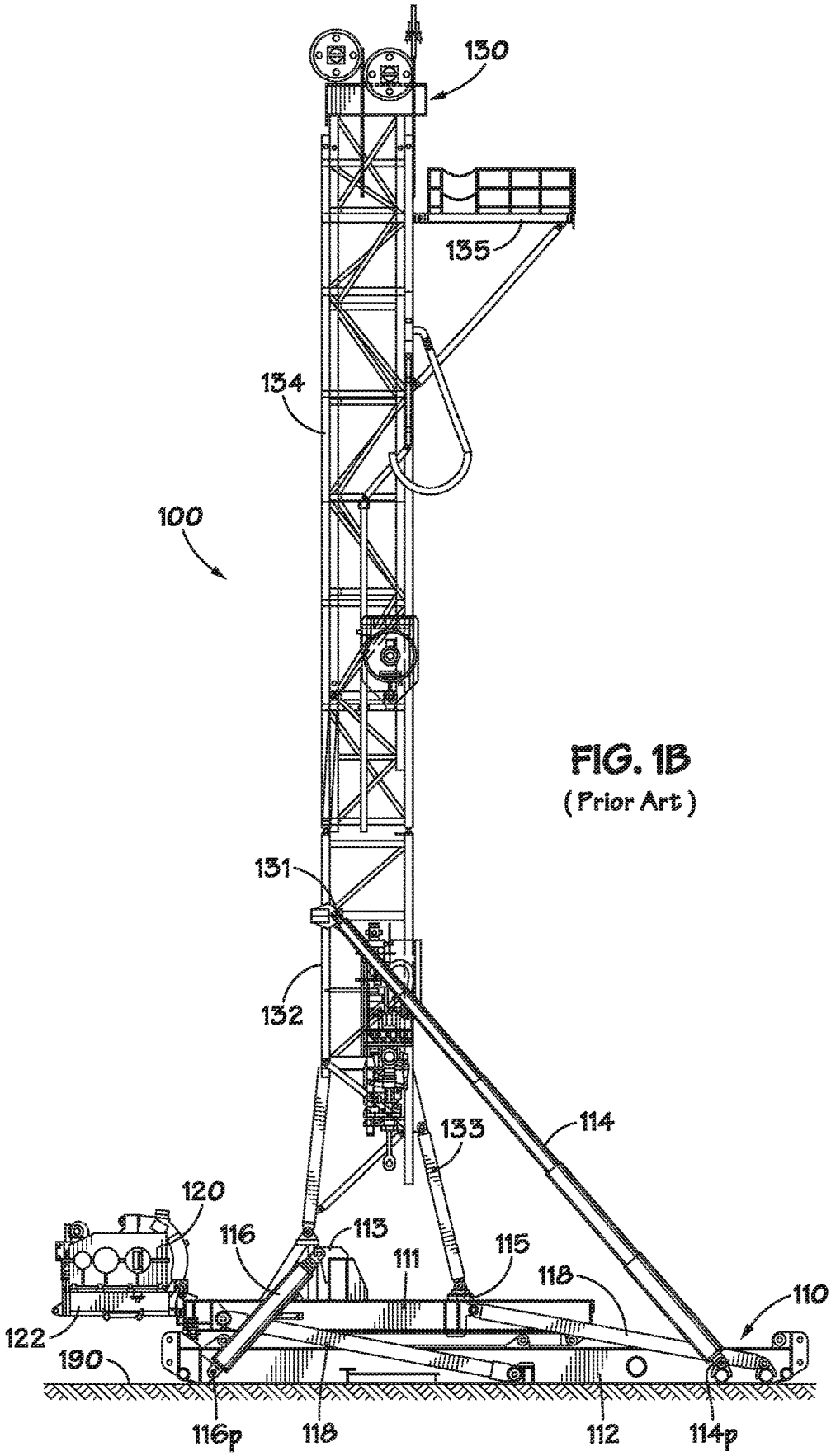
FIG. 1B (Prior Art)
Figure 1C:
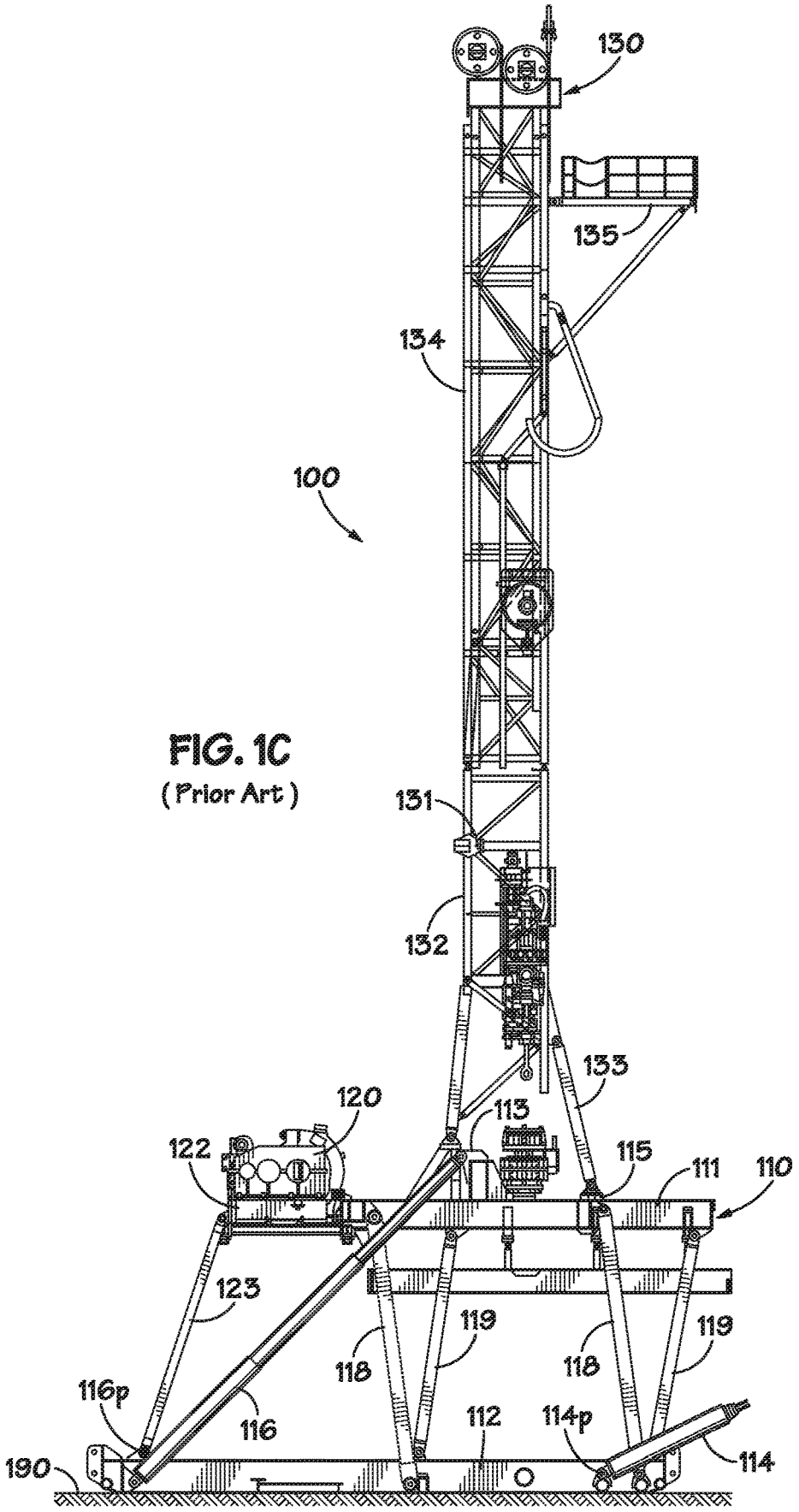
FIG. 1C (Prior Art)
Figure 2A:
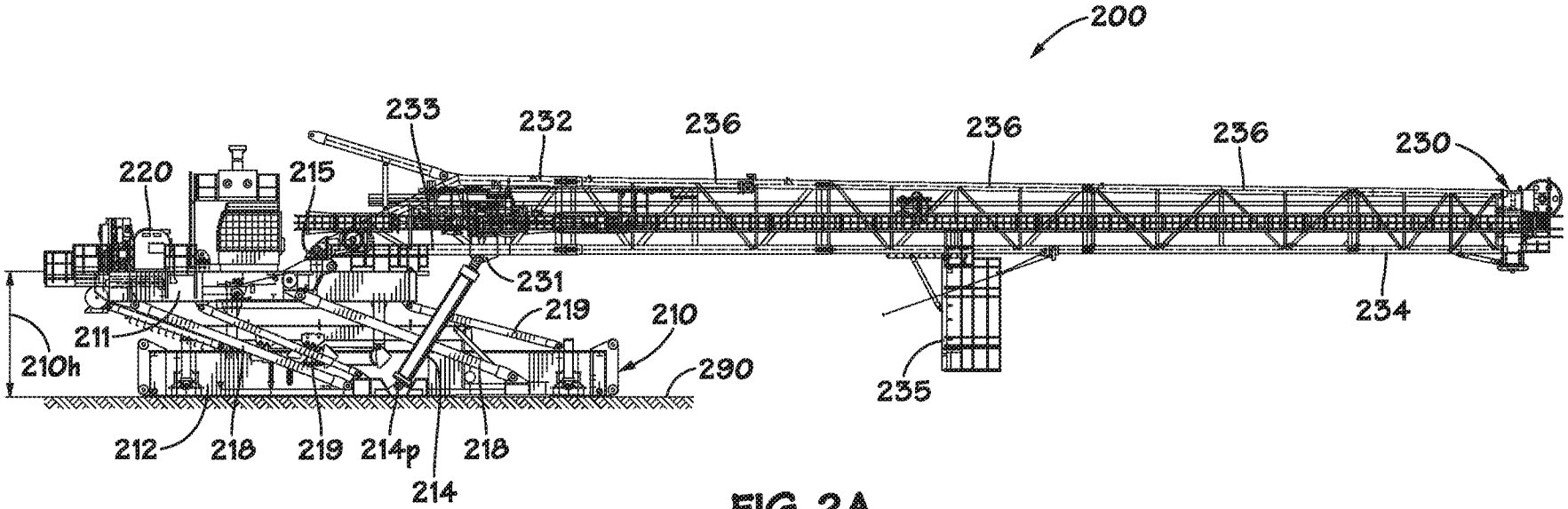
FIG. 2A (Prior Art)
FIGS. 2A-2C are side elevation views of another illustrative drilling rig assembly known in the art.
Figure 2B:
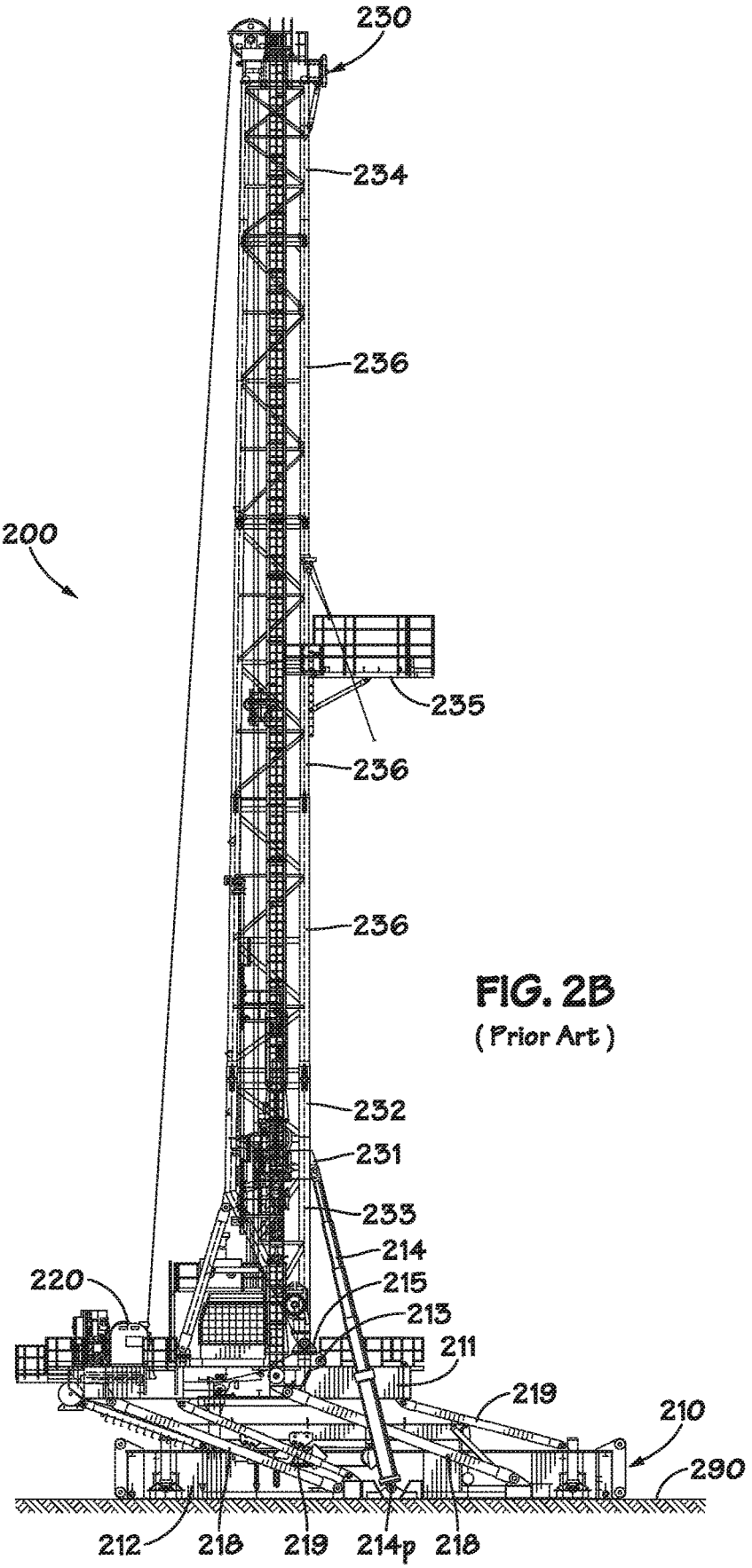
FIG. 2B (Prior Art)
Figure 2C:
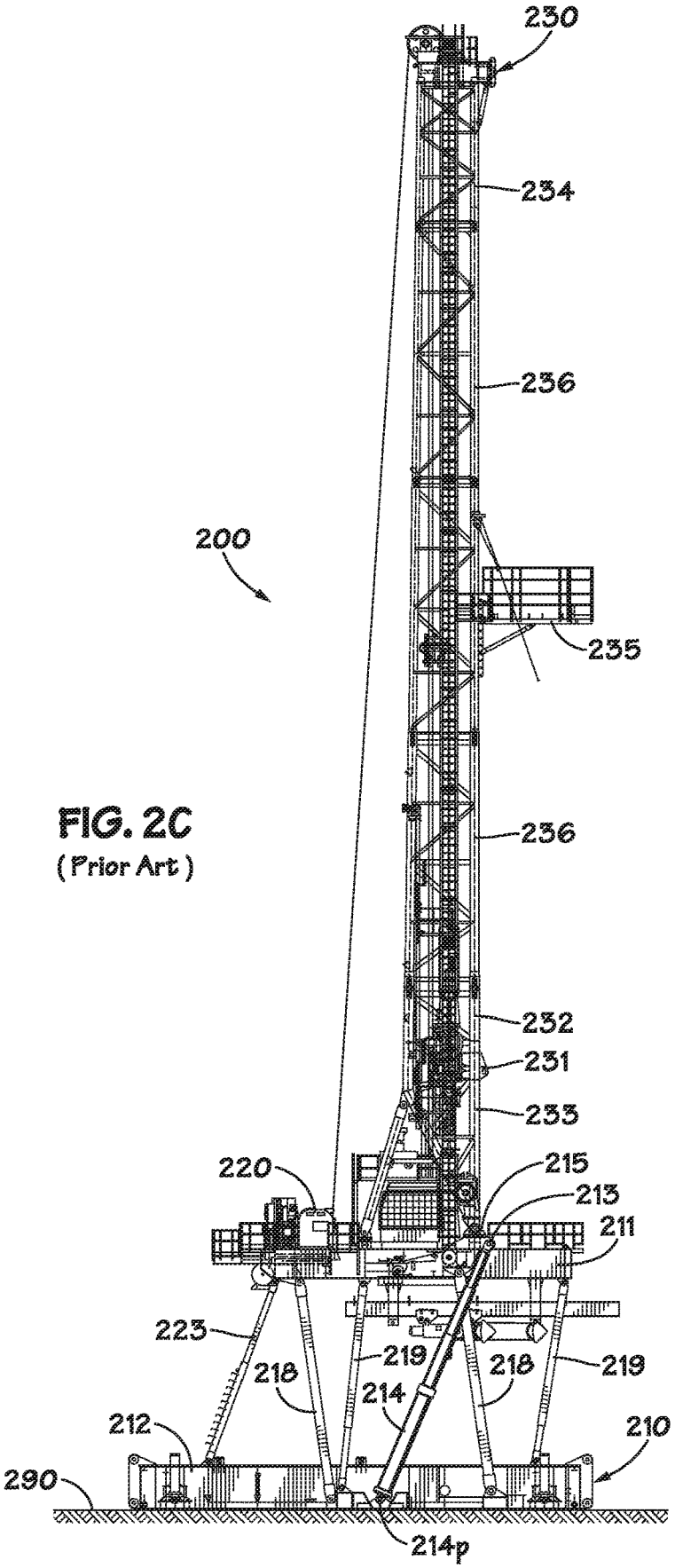
FIG. 2C (Prior Art)
Figure 5A:
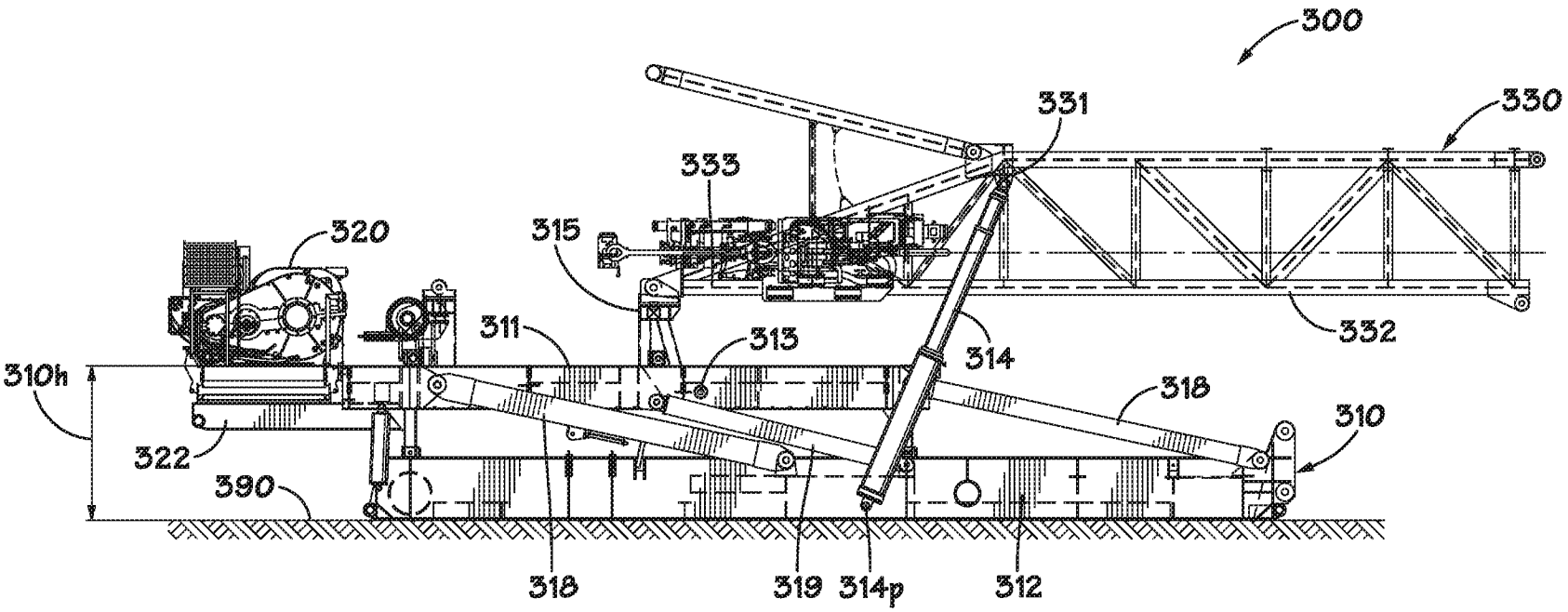

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention.

DETAILED DESCRIPTION

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present subject matter will now be described with reference to the attached figures. Various systems, structures and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Generally, the subject matter disclosed herein is directed to new and unique systems and methods that may be used for raising/erecting the various components of drilling rig assemblies, including drilling rig masts and substructures. FIGS. 3A-3F depict various side elevation views of one embodiment of an exemplary drilling rig assembly 300 of the present disclosure in which two different raising apparatuses 314, 320 may be used to erect a drilling rig mast 330 in two stages from a substantially horizontal orientation to a fully raised operating position, and where one of the two raising apparatuses 314 may be further used to raise a substructure 310 of the drilling rig assembly 300 from a collapsed transportation configuration to a raised operating position after the drilling rig mast 330 has been erected above the substructure, as will be discussed in detail below.

FIG. 3A is a close-up side elevation view of the illustrative drilling rig assembly 300 during an early stage drilling rig assembly and erection. As shown in FIG. 3A, the drilling rig assembly 300 may include a drilling rig substructure 310, a drilling rig mast 330, and a drilling rig drawworks 320. In some embodiments, the drilling rig substructure 310 may be, for example, a collapsible substructure that includes a lower substructure box 312 and an upper substructure box 311 that is adapted to be raised relative to and above the lower substructure box 312. Accordingly, the drilling rig substructure 310 has been depicted in FIG. 3A in a fully collapsed configuration after having been transported to a wellbore site. Furthermore, in the depicted collapsed configuration, the drill rig substructure 310 may have a fully collapsed substructure height **310*h* as measured from a bottom (support) surface of the lower substructure box 312 to a top (drill floor) surface of the upper substructure box 312. In at least some embodiments, the collapsed substructure height 310*h* may range from approximately 2.7-3.7 meters (9-12 feet), however it should be appreciated that the collapsed height 310*h* may vary from this range, depending on the specific design and operational parameters of the drilling rig assembly 300**.

In typical drilling applications, the lower substructure box 312 is adapted to be positioned directly in bearing contact with the ground 390 at the wellbore site, or on a drilling mat that is positioned directly on the ground 390, so as to support the drilling rig assembly 300 by properly transferring drilling rig dead loads and operating loads to the ground 390. As shown in FIG. 3A, the upper substructure box 310 may be coupled to the lower substructure box 312 by way of a plurality of pivotably movable support legs 318 and length-adjustable braces 319. In some embodiments, the upper substructure box 311 may be raised above the lower substructure box 312 by pivotably rotating the support legs 318 and braces 319 until the upper substructure box 311 has been raised to an appropriate operating position above the ground 390, as will be further described in conjunction with FIG. 3F below.

The drilling rig mast 330 may include a bottom mast section 332 having a lower mast support leg 333 that is adapted to be pivotably connected to a mast support shoe 315 that is attached to the upper substructure box 311. Furthermore, the drilling rig mast 330 may also include a top mast section 334, and depending on the specific mast design, it may also include one or more intermediate mast sections 336 positioned between and connecting the bottom mast section 332 to the top mast section 334. However, for additional drawing clarity, the upper and intermediate mast section 334, 336 have not been depicted if FIG. 3A. (See, i.e., FIGS. 3C-3F, described below).

As shown in the assembly and erection stage depicted in FIG. 3A, the lower mast support leg 333 of the bottom mast section 332 has been pivotably connected to the mast support shoe 315. Additionally, a first mast erection apparatus 314 has been coupled between the drilling rig substructure 310 and the drilling rig mast 330 in preparation for performing a first step for raising the mast 330 to a raised operating position above the substructure 310. As shown in the embodiment depicted in FIG. 3A, a lower end of the first mast erection apparatus 314 has been pivotably connected to an apparatus pivot point 314*p* on the lower substructure box 312, and an upper end of the first mast erection apparatus 314 has been pivotably connected to a mast erection lug 331 positioned on the bottom mast section 332. In some embodiments, the first mast erection apparatus 314 may be a cylinder apparatus, such as an hydraulically or pneumatically actuated cylinder apparatus and the like, whereas in particular embodiments it may be a multi-stage telescopic hydraulic cylinder. For example, the first mast erection apparatus 314 may be a multi-stage telescopic cylinder having fewer than four stages—i.e., a two-stage or a three-stage cylinder—since the use of a multi-stage cylinder having four or more stages may be avoided, due at least in part to the substantially reduced extended cylinder length that is provided by the mast erection systems and methods disclosed herein, as will be further described below.

With continuing reference to FIG. 3A, the bottom mast section 332 of the drilling rig mast 330 is illustrated as being horizontally oriented, that is, such that the bottom mast section 332 (or the fully assembled drilling rig mast 330) is oriented parallel to a horizontal plane, such as parallel to the plane of the upper surface of the ground 390. However, it should be understood by those of ordinary skill after a complete reading of the present disclosure that the bottom mast section 332 may be tilted at a slight angle (i.e., by approximately 0° to 5°) either above or below the horizontal plane at any time during the assembly of the drilling rig mast 330 (that is, while attaching the intermediate and top mast sections 336 and 334 to the bottom mast section 332) by pivotably rotating the bottom mast section 332 about the connection to the mast support shoe 315. Accordingly, as used herein and in the attached claims, the term "substantially horizontal orientation" or "substantially horizontally oriented" shall mean oriented or positioned in a plane that is within approximately 5° of being parallel to a horizontal plane.

In certain exemplary embodiments, the drilling rig drawworks 320 may be positioned on a separate drawworks support skid 322, which in turn may be removably attached to the drilling rig substructure 310 at the drawworks end of the upper substructure box 311, as shown in FIG. 3A. Furthermore, in at least some embodiments, the drawworks 320 may be removably attached to, or installed on, the substructure 310 prior to pivotably connecting the lower mast support leg 333 of the bottom mast section 332 to the mast support shoe 315, whereas in other embodiments the drawworks 320 and drawworks support skid 320 may be removably attached to the upper substructure box 311 after the drilling rig mast 330 has been pivotably connected to the mast support shoe 315.

It should be understood that while a single mast erection (e.g., hydraulic cylinder) apparatus 314 is depicted in the elevation view of FIG. 3A, a pair of mast erection (e.g., hydraulic cylinder) apparatuses 314 is typically provided and positioned such that the pair of apparatuses straddle the bottom mast section 332. As such, any reference herein to a "first mast erection apparatus 314" or a "multi-stage telescopic hydraulic cylinder 314" may be understood to also encompass a pair of such apparatuses 314 unless noted otherwise. In similar fashion, references herein to such components as the "lower mast support leg 333" or the "mast support shoe 315" may also be understood to encompass pairs of such components.

Figure 3B:
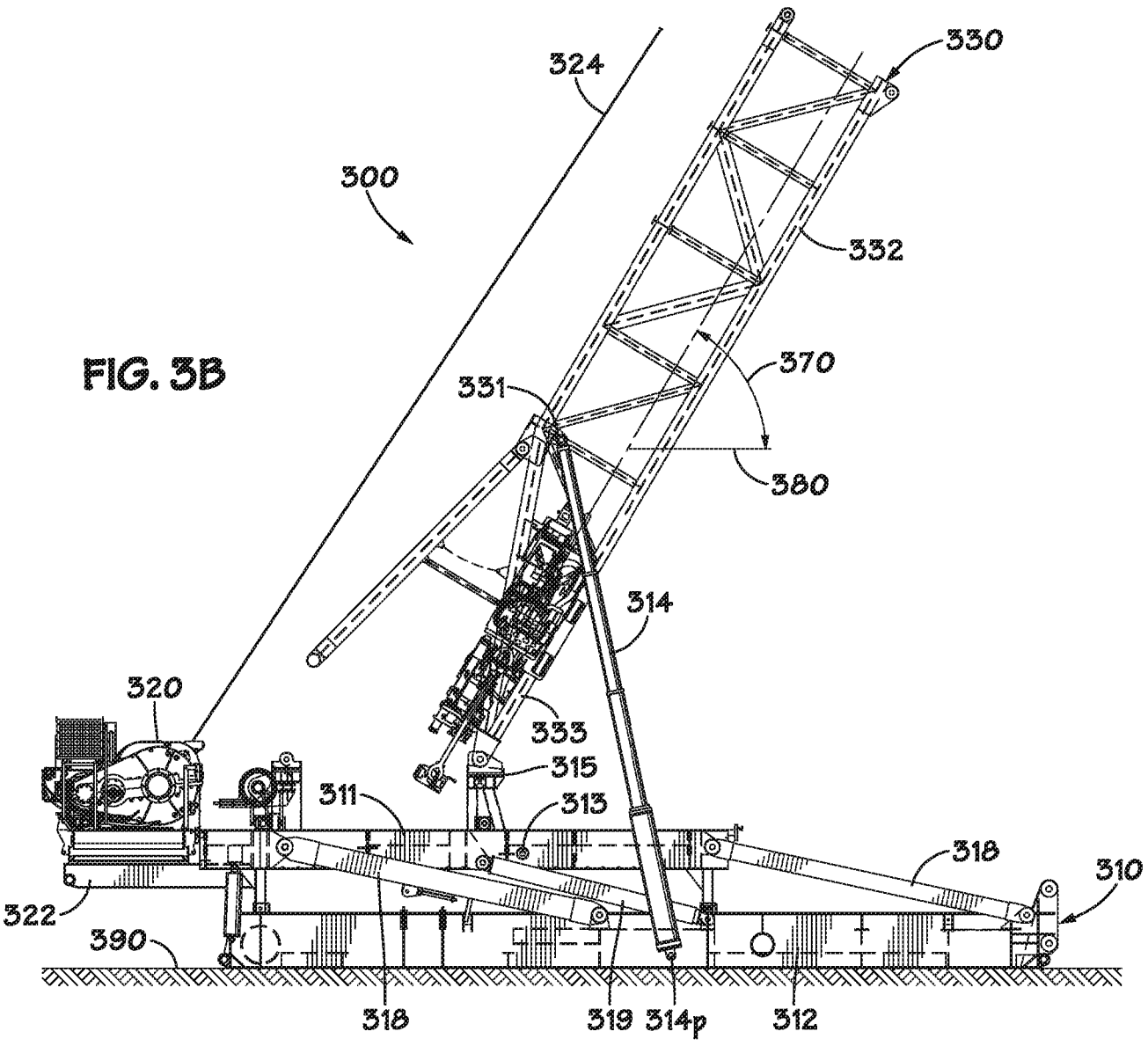

FIG. 3B is a close-up side elevation view of the drilling rig assembly 300 depicted in FIG. 3A after the completion of a first mast erection step, during which the drilling rig mast 330 has been partially raised to its final operating position. As in FIG. 3A, the intermediate and top mast sections 336, 334 of the drilling rig mast 330 have again been excluded from FIG. 3B for drawing clarity.

In performing the first mast erection step, the first mast erection apparatus 314, e.g., the multi-stage telescopic hydraulic cylinder 314, has been actuated (extended) so as to pivotably raise the drilling rig mast 330 by rotating the mast 330 about the pivotable connection between the lower mast support leg 333 and the mast support shoe 315 such that the mast 330 has been raised to an intermediate raised position. As shown in FIG. 3B, the drilling rig mast 330 may be oriented at a first acute angle 370 relative to a horizontal plane 380, that is, at an angle that is less than approximately 90°, when the mast 330 is in the depicted intermediate raised position. In certain embodiments, the first acute angle 370 may range from approximately 40° to 80° relative to the horizontal plane 380, whereas in at least some specific exemplary embodiments, the first acute angle 370 may be between approximately 55° and 70°. However, it should be appreciated by the ordinarily skilled artisan after a complete reading of the present disclosure that the magnitude of the first acute angle 370 will depend the specific design parameters of various relevant drilling rig components, such as, for example, the overall length and dead weight of the drilling rig mast 330, the maximum extended length of the first mast erection apparatus 314, the position of the mast erection lug 331 on the bottom mast section 332, and the like.

Figure 3C:
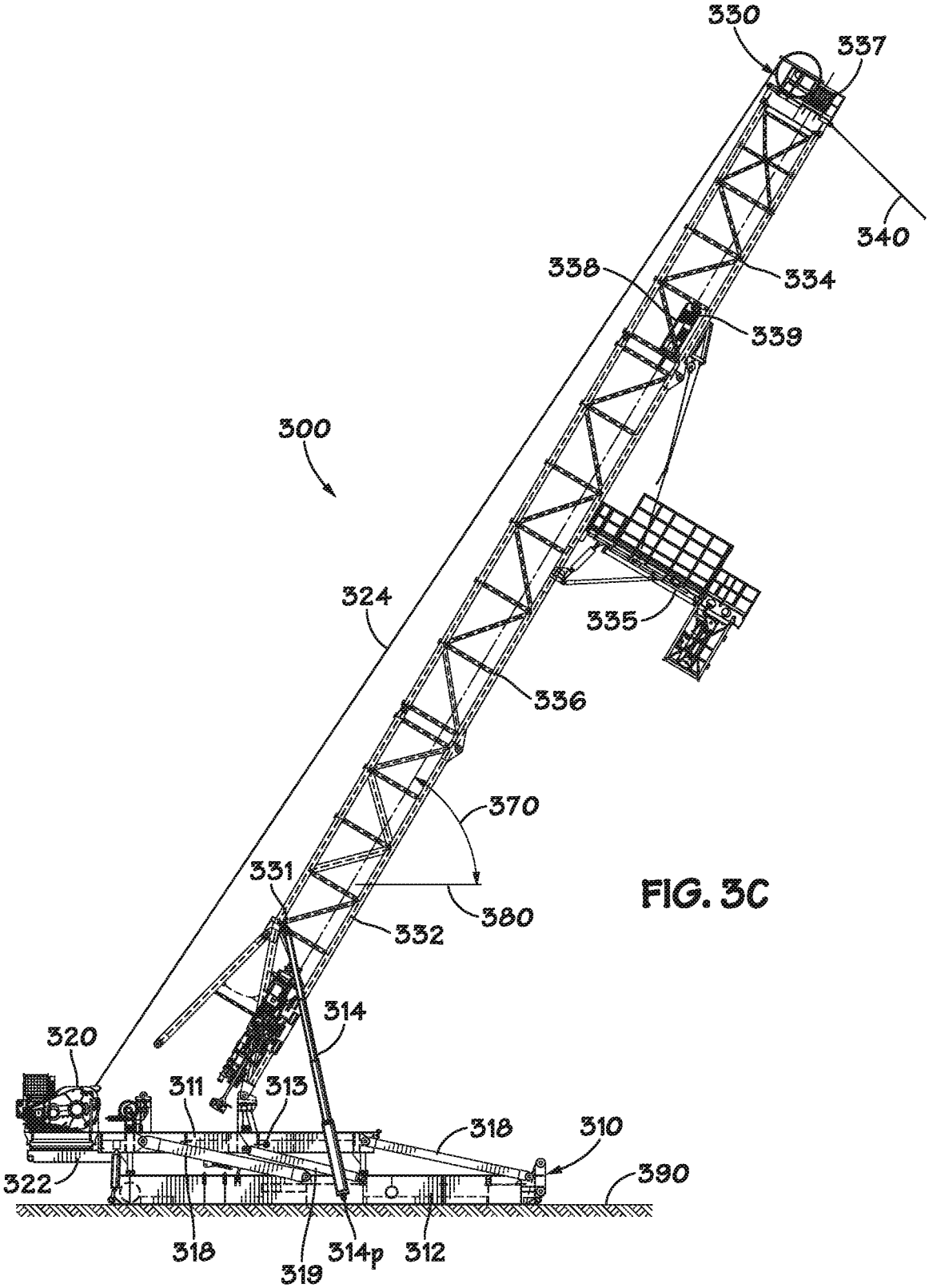

FIG. 3C is a side elevation view of the drilling rig assembly 300 shown in FIGS. 3A and 3B after a subsequent step in the disclosed sequence for raising the drilling rig mast 330 has been performed, wherein the intermediate and top mast sections 336 and 334 of the mast 330 have been included in FIG. 3C so as to further illustrate the remaining steps and support the following description. In certain embodiments, the top mast section 334 may be shipped "pre-assembled," or dressed out with the traveling block 338 installed and the drill lines reeved between the crown block sheaves 337 and the traveling block sheaves 339. The mast 330 is assembled in a substantially horizontal orientation, including the "pre-assembled" top mast section 334, which is attached to the intermediate and bottom mast sections 336 and 332.

Once all of the mast sections 332, 336, and 334 have been fully assembled into a completed drilling rig mast 330, the drawworks end of the drill line 324 is then uncoiled from the top mast section 334, moved down the mast 330, and attached to the drum of the drilling rig drawworks 320, and the opposite (dead line) end of the drill line 324 is securely clamped to predetermined location on the drill floor of the upper substructure box 311. Thereafter, and prior to pivotably raising the drilling rig mast 330 to the intermediate raised position as shown in FIG. 3B, the drawworks 320 is operated so that an initial portion of the drill line 324 is spooled onto the drawworks drum until the drawworks 320 exerts a load on the drill line 324 that is sufficient to pull the drill line 324 taut. In at least some exemplary embodiments, the drawworks 320 is then substantially continuously operated so as to maintain a load that keeps the drill line 324 taut while the first mast erection apparatus (e.g., hydraulic cylinder) 314 is actuated (extended) so as to pivotably raise the drilling rig mast 330 to the intermediate raised position, as previously described with respect to FIG. 3B above.

With continuing reference to FIG. 3C, once the drilling rig mast 330 has been pivotably raised to the intermediate raised position i.e., such that the mast 330 is oriented at the first acute angle 370 relative to the horizontal plane 380 the drilling rig drawworks 320 is operated to tension the drill line 324, and the drawworks brakes are set so as to hold the drill line 324 in place, thus maintaining the drilling rig mast 330 in the intermediate raised position. Once the drawworks brakes have been set, the first mast erection apparatus (e.g., multi-stage telescopic hydraulic cylinder) 314 is then actuated by slightly retracting the cylinder, thereby transferring the dead load of the drilling rig mast 330 from the first mast erection apparatus 314 to the drill line 324 and the drawworks 320. After transferring the dead load of the mast 330 to the drill line 324 and the drawworks 320, the upper end of the first mast erection apparatus 314 may then be disconnected from the mast erection lug 331, after which the first mast erection apparatus 314 may be actuated to a fully retracted position as shown in FIG. 3D.

Figure 3D:
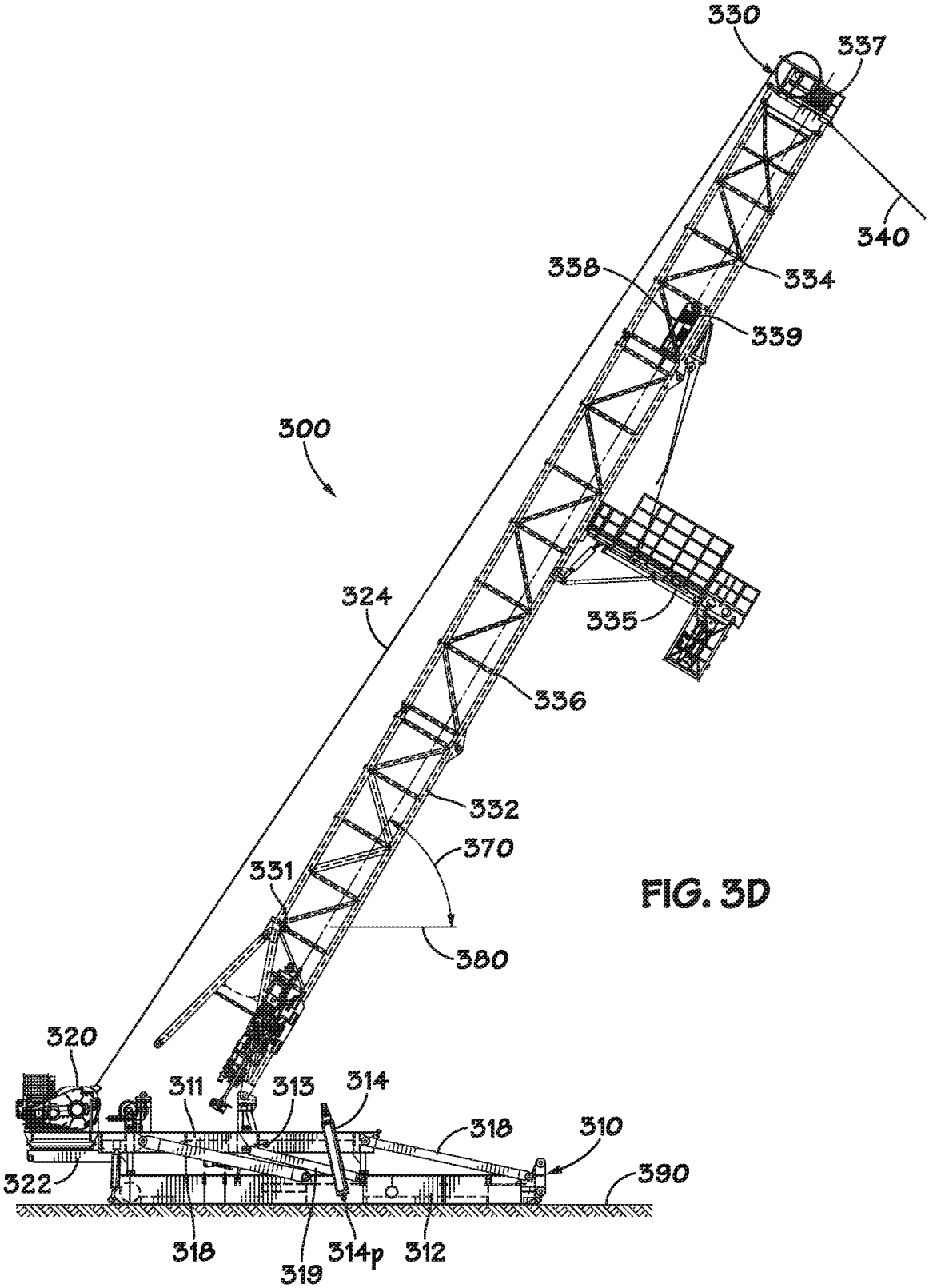
Figure 3E:
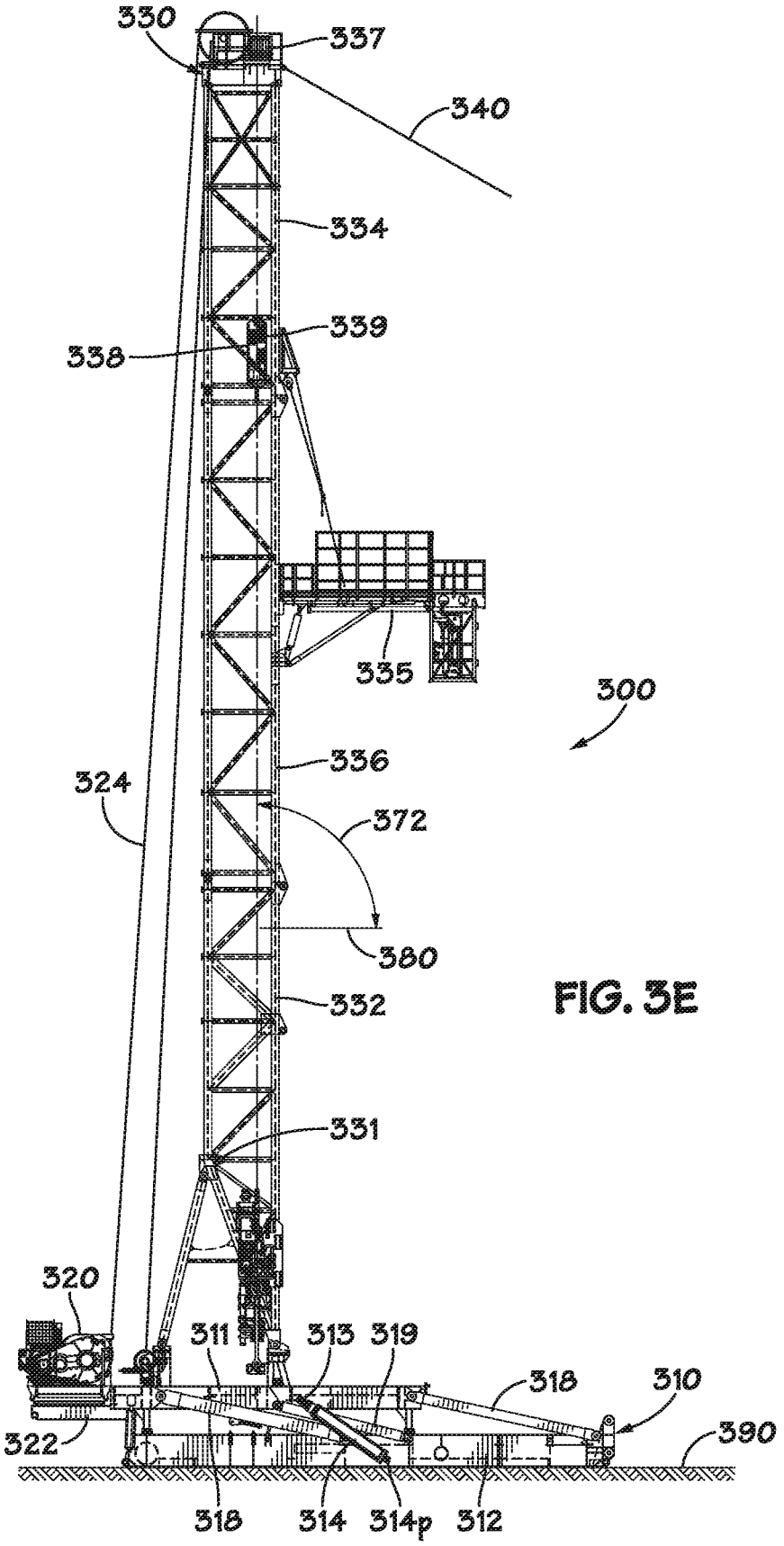

FIG. 3E is a side elevation view of the drilling rig assembly 300 depicted in FIGS. 3C and 3D after a second mast erection step has been performed so as to finish raising the partially raised drilling rig mast 330 from the intermediate raised position (oriented at the first acute angle 370) shown in FIGS. 3B-3D to a fully raised operating position above the substructure 310. During the second mast erection step, the drilling rig drawworks 320 is operated so as to further spool in the drill line 324 onto the drawworks drum. In this way, the drawworks 320 is thus used as a second mast erection apparatus to further pivotably raise the partially raised drilling rig mast 330 from the intermediate raised position at the first acute angle 370 to a fully raised operating position by again pivotably rotating the mast 330 about the between the lower mast support leg 333 and the mast support shoe 315. As shown in FIG. 3E, once the drilling rig mast 330 has been further pivotably raised to its fully raised operating position, the mast 330 is then oriented at a second angle 372 relative to the horizontal plane 380.

In some illustrative embodiments, the drilling rig mast 330 may be oriented substantially perpendicular to the horizontal plane 380 when the mast is in the fully raised operating position, such that the second angle 372 is approximately 90°. However, it should be appreciated by one of ordinary skill in the art that when the drilling rig assembly 300 is adapted for slant drilling operations, the second angle 372 may be a second acute angle that is less than approximately 90°, for example, in the range of approximately 60° to 75°. In such embodiments, the first acute angle 370 that defines the orientation of the drilling rig mast 330 after it has been partially raised to the intermediate raised position may also be commensurately smaller, such as in the range of approximately 40° to 55°.

In some exemplary aspects of the present disclosure, the first mast erection apparatus (e.g., multi-stage telescopic hydraulic cylinder) 314 may be fully stroked to a maximum extended length when the drilling rig mast 330 is in the intermediate raised position and oriented substantially at the first acute angle 370. However, in other embodiments, the first mast erection apparatus 314 may only be partially stroked, that is, to an extended length that is less than the apparatus's maximum extended length, when the mast 330 is oriented at the first acute angle 370. In such embodiments, the first mast erection apparatus 314 may therefore be capable of further raising the drilling rig mast 330 to an orientation that is beyond the intermediate raised position, such that the mast 330 is oriented at a third acute angle that is greater than the first acute angle 370 but still less than the second angle 372.

With continuing reference to FIGS. 3D and 3E, a snubbing line 340 may be attached to the top mast section 334 to control movement of the drilling rig mast 330 during the latter portion of the second mast erection step that is performed by using the drilling rig drawworks 320, i.e., the second mast erection apparatus. For example, in some embodiments, the snubbing line 340 may be spooled onto a winch truck that is used to restrain any substantially uncontrolled movement of the drilling rig mast 330 as the mast 330 breaks over its center of gravity (C.G.) while being raised to a fully vertical operating position. In this way, any impact loads on the mast 330 and the substructure 310 as the mast settles into its final operating orientation can thus be minimized or even substantially eliminated. In some embodiments, the mast orientation at which this C.G. break over occurs may be at an acute angle relative to the horizontal plane 380 that is in the range of approximately 84° to 88°, although it should be appreciated that the C.G. break over angle will generally vary depending on the dead load distribution of the drilling rig mast 330, including the positioning of the traveling block 338 and the elevation of the diving board platform 335, and the like. Alternatively, snubbing cylinders (not shown) that are coupled between the drilling rig mast 330 and the upper substructure box 311 may also be used to control the C.G. break over.

Figure 3F:
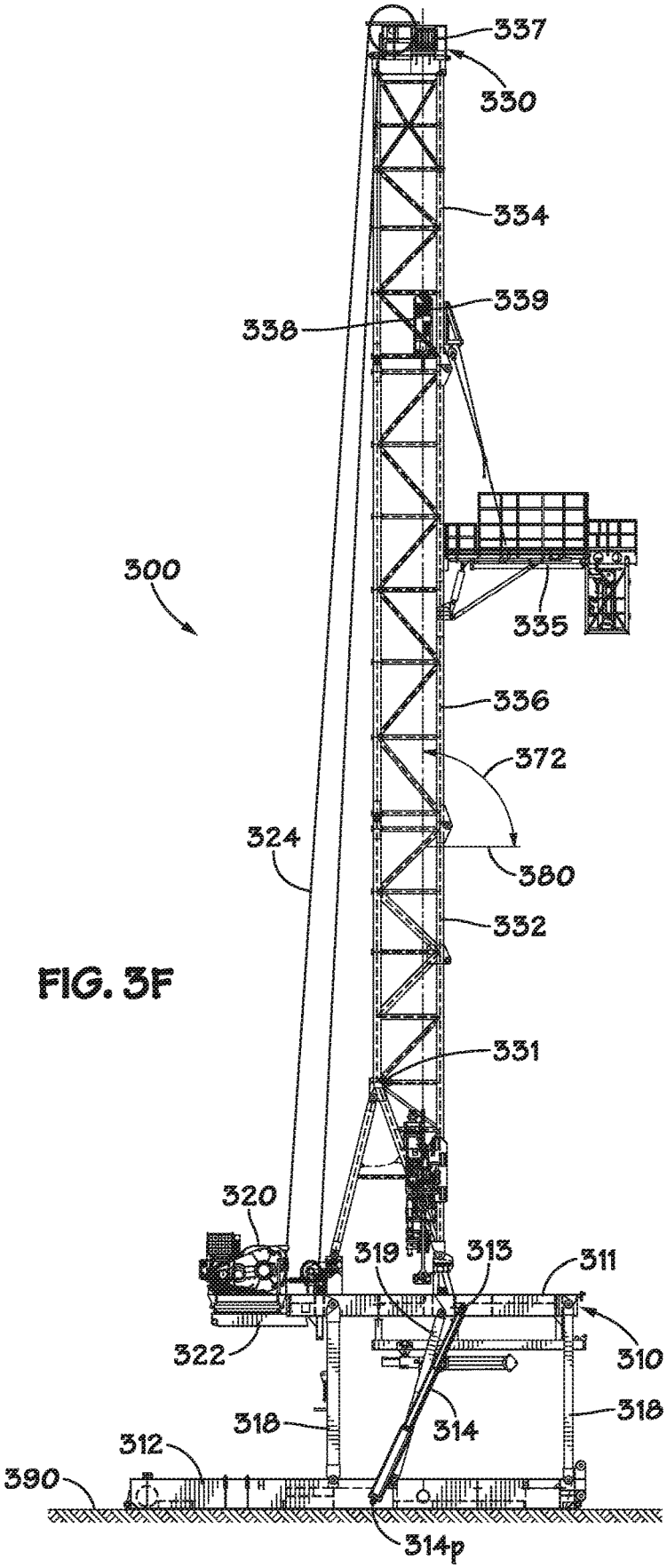

FIG. 3F is a side elevation view of the drilling rig assembly 300 of FIGS. 3C-3E after the completion of a further rig assembly and erection step, wherein the drilling rig substructure 310 has been raised to a final operating height for performing drilling operations. As shown in FIG. 3F, the drilling rig mast 330 has been pivotably raised to the fully raised position and oriented at the second angle 372, and the upper end of the previously retracted first mast erection apparatus 314, e.g., a multi-stage telescopic hydraulic cylinder, has been pivotably connected to the substructure erection lug 313 on the upper substructure box 311. Furthermore, the first mast erection apparatus 314 has again been actuated (extended) so as to raise the upper substructure box 311 relative to and above the lower substructure box 312 by pivotably rotating the support legs 318 and the length-adjustable braces 319. Additionally, the length-adjustable braces 319 have been fixed in place so as to substantially stabilize the raised substructure 310 at the appropriate operating height above the ground 390.

As will be noted by comparing the relative extended lengths of the first mast erection apparatus 314 as shown in FIGS. 3B and 3C to that shown in FIG. 3F, the apparatus 314 has been stroked by a greater length when raising the drilling rig mast 330 to the intermediate raised position (FIGS. 3B and 3C) than when raising the substructure 310 to the final operating height (FIG. 3F), as indicated by extension of approximately one additional cylinder stage in FIGS. 3B and 3C. However, when compared to the hydraulic cylinder 214 of the prior art drilling rig system 300, the smaller and more compact design of the first mast raising apparatus 314 does not unduly impact the minimum collapsed height 310*h* and subsequent overall shipping height of the substructure 310, while still being able to utilize the same erection apparatus 314 to perform both the mast raising operation and the substructure raising operation.

In view of the foregoing description and figures, the subject matter disclosed herein therefore provides detailed aspects of various systems and methods that may be used for raising and erecting the various components of high capacity drilling rig assemblies, such as drilling rig masts and assemblies, while maintaining the overall transportability of the drilling rig assembly components over roads and highways.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended by the details of construction or design herein shown, other than as described in the claims below. It is therefore evident that the particular embodiments disclosed above may be altered or modified and all such variations are considered within the scope of the invention. Accordingly, the protection sought herein is as set forth in the claims below.

What is claimed:

1. A method of erecting a drilling rig mast, the method comprising:

pivotably connecting a drilling rig mast to a collapsible drilling rig substructure;

pivotably connecting a first mast erection apparatus to said drilling rig mast;

pivotably raising said drilling rig mast with said first mast erection apparatus to an intermediate raised position such that said drilling rig mast is oriented at a first acute angle relative to a horizontal plane;

coupling a second mast erection apparatus to said drilling rig mast;

pivotably raising said drilling rig mast with said second mast erection apparatus from said intermediate raised position at said first acute angle to a fully raised operating position such that said drilling rig mast is oriented at a second angle relative to said horizontal plane that is greater than said first acute angle, wherein said first mast erection apparatus is disconnected from said drilling rig mast prior to pivotably raising said drilling rig mast to said fully raised operating position; and after pivotably raising said drilling rig mast with said first mast erection apparatus to said intermediate raised position, pivotably attaching said first mast erection apparatus to said collapsible drilling rig substructure and raising, with said first mast erection apparatus, said collapsible drilling rig substructure from a collapsed configuration to a raised operating configuration.

2. The method of claim 1, wherein said first mast erection apparatus is a different type of erection apparatus from said second mast erection apparatus.

3. The method of claim 1, wherein said first acute angle is in a range of approximately 40° to 80° and said second angle is approximately 90°.

4. The method of claim 1, wherein said second mast erection apparatus comprises a drilling rig drawworks, and wherein coupling said second mast erection apparatus to said drilling rig mast comprises reeving a drill line of said drilling rig drawworks over crown block sheaves of said drilling rig mast and attaching an end portion of said drill line to a drum of said drilling rig drawworks.

5. The method of claim 4, further comprising, after pivotably raising said drilling rig mast to said intermediate raised position with said first mast erection apparatus and prior to pivotably raising said drilling rig mast to said fully raised operating position with said second mast erection apparatus, transferring a dead load of said drilling rig mast to said second mast erection apparatus by operating said drilling rig drawworks to spool said drill line onto said drum.

6. The method of claim 5, wherein said dead load of said drilling rig mast is transferred to said second mast erection apparatus while said first mast erection apparatus remains pivotably connected to said drilling rig mast.

7. The method of claim 1, wherein said first mast erection apparatus comprises an hydraulic cylinder that, when fully stroked to a maximum extended length, pivotably rotates said drilling rig mast to a third acute angle that is greater than or equal to said first acute angle and less than said second angle.

8. The method of claim 7, wherein said hydraulic cylinder is a multi-stage telescopic hydraulic cylinder comprising three stages.

9. A method of erecting a drilling rig mast, the method comprising:

pivotably connecting a drilling rig mast to a collapsible drilling rig substructure;

pivotably connecting at least one hydraulic cylinder to said drilling rig mast;

pivotably raising said drilling rig mast with said at least one hydraulic cylinder to an intermediate raised position such that said drilling rig mast is oriented at a first acute angle relative to a horizontal plane;

coupling a drilling rig drawworks to said drilling rig mast;

after pivotably raising said drilling rig mast to said intermediate raised position with said at least one hydraulic cylinder, transferring a dead load of said drilling rig mast to said drilling rig drawworks; and pivotably raising said drilling rig mast with said drilling rig drawworks from said intermediate raised position at said first acute angle to a fully raised operating position such that said drilling rig mast is oriented at a second angle relative to said horizontal plane that is greater than said first acute angle.

10. The method of claim 9, wherein said first acute angle is in a range of approximately 40° to 80° and said second angle is approximately 90°.

11. The method of claim 9, further comprising disconnecting said at least one hydraulic cylinder from said drilling rig mast prior to pivotably raising said drilling rig mast to said fully raised operating position with said drilling rig drawworks.

12. The method of claim 9, wherein coupling said drilling rig drawworks to said drilling rig mast comprises reeving a drill line of said drilling rig drawworks over crown block sheaves of said drilling rig mast and attaching an end portion of said drill line to a drum of said drilling rig drawworks.

13. The method of claim 12, wherein transferring said dead load of said drilling rig mast to said drilling rig drawworks comprises operating said drilling rig drawworks to spool said drill line onto said drum.

14. The method of claim 12, wherein pivotably raising said drilling rig mast from said intermediate raised position at said first acute angle to said fully raised operating position at said second angle comprises operating said drilling rig drawworks to spool said drill line onto said drum.

15. The method of claim 9, wherein said drilling rig drawworks is coupled to said drilling rig mast after pivotably raising said drilling rig mast to said intermediate raised position with said at least one hydraulic cylinder.

* * * * *